United States Patent [19]

Spokas et al.

[11] Patent Number: 4,489,680

[45] Date of Patent: Dec. 25, 1984

[54] ENGINE TEMPERATURE CONTROL SYSTEM

[75] Inventors: Romas B. Spokas; Fred D. Sturges, both of Rockford, Ill.

[73] Assignee: Borg-Warner Corporation, Chicago, Ill.

[21] Appl. No.: 573,188

[22] Filed: Jan. 23, 1984

[51] Int. Cl.[3] ..... F01P 3/20

[52] U.S. Cl. ..... 123/41.05; 123/41.1; 123/41.12; 123/41.49

[58] Field of Search ..... 123/41.02, 41.04, 41.05, 123/41.08–41.1, 41.12, 41.49

[56] References Cited

U.S. PATENT DOCUMENTS

| | | | |
|---|---|---|---|
| 2,189,888 | 2/1940 | Endsley | 123/41.05 |
| 2,291,283 | 7/1942 | Klein et al. | 123/41.05 |
| 3,854,459 | 12/1974 | Stimeling | 123/41.05 |
| 4,228,880 | 10/1980 | Gee | 192/58 B |
| 4,348,990 | 9/1982 | Nolte et al. | 123/41.12 |

*Primary Examiner*—William A. Cuchlinski, Jr.
*Attorney, Agent, or Firm*—James E. Tracy

[57] ABSTRACT

The operating temperature of an internal combustion engine is maintained within desired limits by employing a single coolant temperature sensor for controlling and coordinating the operation of three different temperature control devices for the engine coolant. When the sensed coolant temperature is in a relatively low range a flow control valve controls the amount of coolant diverted from the engine jacket to a radiator to dissipate heat absorbed by the coolant from the engine. If the coolant temperature exceeds that low range, even though the control valve is fully open and all of the coolant is circulated through the radiator, the sensor then effects the opening of radiator shutters to cause ram air to impinge on the radiator to increase the cooling of the coolant. If the temperature still continues to rise after the shutters are fully open, the coolant sensor causes operation of a variable speed fan drive to blow a sufficient amount of air through the radiator to cool the coolant back down to the desired operating range. Such sequential operation of the three control devices provides close temperature control within a relatively narrow range despite wide variations of external conditions and load on the engine, resulting in higher efficiency and longer engine life.

11 Claims, 3 Drawing Figures

ENGINE TEMPERATURE CONTROL SYSTEM

BACKGROUND OF THE INVENTION

This invention relates to a temperature control system, for an internal combustion engine, having several different temperature control devices rendered operable as needed to maintain the engine temperature at a preselected desired level in the presence of widely varying external and load conditions.

Internal combustion engines used in trucks may have three separate controls to keep the operating temperature constant at an optimum point. A thermostat or flow control valve is usually installed in the engine block to sense or monitor the temperature of the coolant in the engine jacket, which coolant is circulated around the jacket by a coolant or water pump, and to divert a larger and larger amount of the coolant from the jacket to the truck's radiator to dissipate the engine heat as the coolant temperature rises through a relatively small temperature range. At that time no appreciable air is passing through the radiator but the total volume of coolant available to absorb the heat from the engine has been increased. If the coolant temperature continues to increase even with the thermostat fully open and with all of the coolant being circulated through the radiator, controllable radiator shutters will now become operable. These shutters are like venetian blinds and are positioned in front of the radiator. They may be of the variable opening type or the on-off type and are normally closed so that no air can be drawn therethrough and to the radiator. A separate temperature sensor controls the operation of the radiator shutters and they will be opened by the sensor if the engine temperature exceeds the desired level after the thermostat is fully opened. With the shutters open, ram air is allowed to impinge on the radiator to effect cooling of the coolant circulating through the radiator and engine block. Ram air is the effective air that, due to the truck's velocity, strikes the radiator. Of course, if the truck is stationary there would be no ram air.

If the load on the engine or external conditions, such as the outside ambient temperature, causes the coolant temperature to continue rising even with the thermostat and shutters fully open, a third temperature sensor will control the operation of a variable speed fan drive to pull outside air in through the shutters and then through the radiator to effect cooling of the coolant, the amount of air blown through the radiator, and hence the amount of heat dissipated, being proportional to the fan speed. It is this third temperature control device that will be capable of providing as much cooling to the coolant as needed to keep the coolant temperature at the required level for optimum engine performance. Moreover, by setting the fan speed only as high as necessary to maintain the desired optimum engine temperature, energy will be conserved.

It is of utmost importance that the three temperature control devices function in the proper sequence. For example, if the fan is operated before the shutters open a vacuum is created and the air flow becomes stalled, producing a very noisy condition. As another example, if the thermostat fails to open but the shutters and fan are rendered operable, no coolant flows to the radiator and the shutters and fan become ineffective. Unfortunately, in the past it has been extremely difficult to obtain the correct sequential operation of the thermostat, shutters and fan drive. Since three separate sensors are needed, whenever one of the sensors drifts out of calibration the required operating sequence will be disrupted. Each of the sensors, and the actuator that it controls, has a characteristic operating range and hysteresis which is extended further by reasonable manufacturing tolerances. In order for the control devices to work in the correct sequence, a rather wide total control range results. Engine temperature, allowed to vary over such a wide range, becomes dependent on such factors as load and ambient conditions. This wide temperature variation is not desirable due to its effects on engine efficiency and engine life.

The present invention constitutes an improvement over these prior engine temperature control systems by ensuring the proper sequential action of the coolant flow control valve, the radiator shutters and the variable speed fan drive. Moreover, the invention achieves a desirable reduction in the operating temperature range, namely closer temperature control to within narrow limits, resulting in higher efficiency and longer engine life.

SUMMARY OF THE INVENTION

The invention provides an engine temperature control system for maintaining the temperature of coolant, in the engine jacket of an internal combustion engine, within desired narrow limits regardless of external conditions and load on the engine. The temperature control system comprises a radiator through which the coolant may be circulated from the engine jacket to effect cooling of the coolant. A temperature sensor is provided for sensing the temperature of the coolant in the engine jacket, and there are means responsive to the temperature sensor for producing a controlled fluid pressure which is a function of and represents the sensed temperature. A coolant flow control valve responds to the fluid pressure, when the sensed coolant temperature is in a relatively low temperature range, to vary the amount of coolant diverted to and flowing through the radiator. Radiator shutters are controlled by the fluid pressure, when the sensed temperature is in a medium temperature range above the low temperature range, for adjusting the amount of ram air impinging on the radiator. Finally, the temperature control system includes a variable speed fan drive which responds to the fluid pressure, when the sensed coolant temperature is in a relatively high temperature range above the medium range, to blow a controlled amount of air through the radiator.

DESCRIPTION OF THE DRAWING

The features of the invention which are believed to be novel are set forth with particularity in the appended claims. The invention may best be understood, however, by reference to the following description in conjunction with the accompanying drawing in which:

DESCRIPTION OF THE ILLUSTRATED EMBODIMENTS

Figure 1:
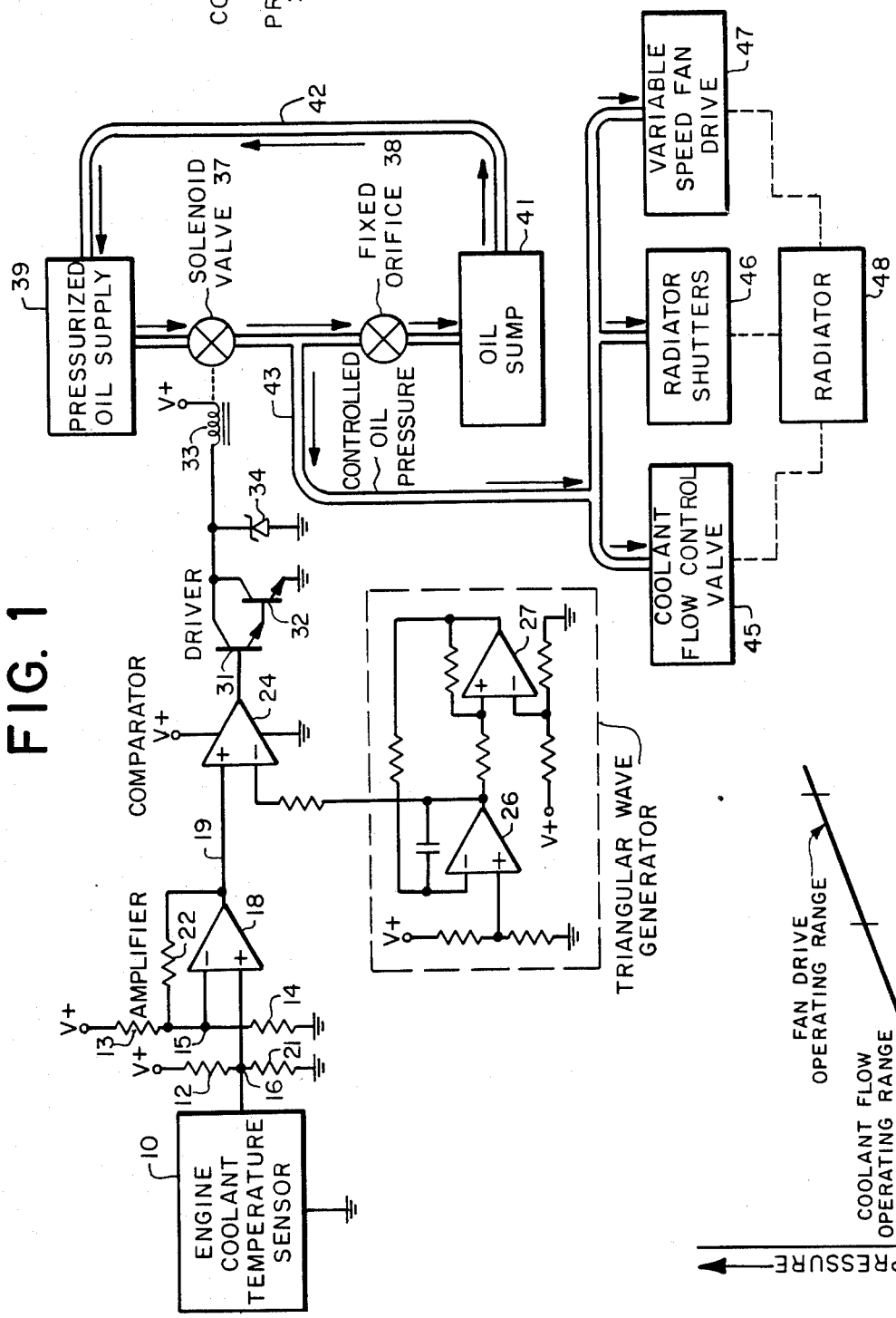
FIG. 1 schematically illustrates a temperature control system, for an internal combustion engine, constructed in accordance with one embodiment of the invention.

It will be assumed that the temperature control system shown in FIG. 1 is incorporated in a truck engine, but it will be apparent that the invention can be employed with any internal combustion engine having several temperature control devices that are operated in sequence to maintain a desired engine operating temperature.

Temperature sensor 10 senses the temperature of the coolant in the engine jacket and may be located at any convenient point in the coolant flow path. Preferably, the sensor is positioned where the coolant will be the hottest in the engine jacket, such as at the top of the engine block where the conventional thermostat is usually located. Sensor 10 comprises a thermistor having a positive temperature coefficient so that its resistance is directly proportional to the coolant temperature. Resistors 12, 13 and 14 in conjunction with the resistance of sensor 10 form a bridge circuit. As the sensed coolant temperature changes, the voltage across circuit junctions or points 15 and 16 varies proportionally. Since sensor 10 has a positive temperature coefficient, when the coolant temperature increases, for example, the resistance of the sensor increases and the voltage at junction 16 increases relative to the fixed voltage at junction 15. Amplifier 18 amplifies the voltage difference between junctions 15 and 16 to produce on conductor 19 a voltage signal, which may be called a "temperature signal", having an amplitude directly proportional to the sensed coolant temperature. Resistors 21 and 22 control the amount of amplification.

A pulse width modulated signal is developed having a waveshape determined by the temperature signal on line 19. To explain, a pulse width modulated signal is rectangular shaped, containing periodically recurring positive-going pulse components with intervening negative-going pulse components. The frequency will be constant but the relative widths of the positive and negative pulse components will vary depending on the amplitude of the temperature signal. As the width or duration of each positive pulse component increases, each negative pulse component decreases proportionately, and vice versa. In other words, since the period or time duration of a complete cycle is constant, when the duration of a positive pulse component changes in one sense or direction the width of the immediately succeeding negative pulse component must change in the opposite sense. The pulse width modulated signal has a duty cycle characteristic which is the ratio of the width of each positive-going pulse compared to the duration of a complete cycle.

The pulse width modulated signal is developed at the output of comparator 24. Amplifiers 26 and 27, and their associated circuit elements, form a well-known triangular wave generator or oscillator for supplying a triangular shaped voltage signal to the negative or inverting input of comparator 24, the positive or non-inverting input of which receives the temperature signal. Preferably, the frequency of the triangular shaped signal is approximately 10 hertz. The voltage at the negative input will vary alternately above and below the voltage level of the temperature voltage signal at the positive input. Each time the alternating voltage at the negative input drops below the temperature voltage at the positive input, the output voltage of comparator 24 abruptly switches from ground or zero volts to V+, such as +12 volts d-c, where it remains until the triangular shaped voltage signal at the negative input becomes greater than the temperature voltage signal at the positive input. At that instant, the output voltage of the comparator switches from its high level (V+) back to its low level or zero. The greater the amplitude of the temperature signal, the greater the time intervals during which the output of comparator 24 is established at its high potential level and the smaller the time intervals when the output is at zero potential. In this way, the output of comparator 24 provides a pulse width modulated, rectangular shaped signal, the relative widths of the alternating positive-going and negative-going pulses being modulated under the control of the temperature signal on line 19. The duty cycle of the pulse width modulated signal is the ratio of the time interval of one positive pulse component compared to a complete cycle, namely the total time duration of one positive pulse component and one negative pulse component. Hence, the duty cycle of the pulse width modulated signal at the output of comparator 24 will be directly proportional to the sensed coolant temperature.

The pulse width modulated signal operates the driver, comprising transistors 31 and 32, to effectively apply that signal to solenoid coil 33. The V+ operating potential at the right terminal of coil 33 may also be the +12 volts. During each positive-going pulse when the output of comparator 24 is established at its high level, transistors 31 and 32 conduct and the left terminal of coil 33 will be essentially grounded, thereby applying a full 12 volts d-c across the coil. During the intervening negative-going pulses, when the output of comparator 24 is zero, transistors 31 and 32 will be turned off and coil 33 will be de-energized. Hence, coil 33 is alternately energized and de-energized, namely cycled on and off, and its duty cycle is the same as, and is determined by, the duty cycle of the pulse width modulated signal. Zener diode 34 protects transistors 31 and 32 against inductive voltage spikes generated by coil 33 turning off.

Solenoid off-on valve 37 is controlled by solenoid coil 33, and since it is turned on and off at a relatively fast rate, the valve effectively provides a variable orifice or opening the size of which is determined by the energization of coil 33. Each time coil 33 is energized valve 37 is opened, and when the coil is de-energized the valve is closed. Thus, the greater the energization of coil 33, namely the greater the duty cycle, the less restriction introduced by valve 37 and the greater the effective opening or orifice.

Solenoid valve 37 is interposed in series with an oil circuit, the oil flowing from a pressurized oil supply 39 through valve 37 and then through a fixed orifice 38 to an oil sump 41, from which the oil is returned over oil line 42 to the pressurized oil supply 39 which would include an oil pump. Of course, in an internal combustion engine, especially a truck engine, many sources of oil pressure are readily available. The engine oil pressure may be used, or pressurized oil may be obtained from the transmission supply. Moreover, and as will be made apparent, oil pressure is not essential. Any source of pressurized fluid will suffice. For example, air pressure from air compressors, usually included in trucks, may be employed.

With the illustrated oil circuit, the oil pressure in oil line 43, which connects to the junction between valve 37 and fixed orifice 38, will constitute a controlled fluid (oil) pressure which is a function of and represents the sensed coolant temperature. Specifically, the controlled oil pressure in line 43 is directly proportional to the sensed temperature. To explain further, if the coolant temperature is relatively low the duty cycle of solenoid valve 37 will likewise be relatively low and the effective opening of valve 37 will be relatively small. As a result, the restricton to the flow of oil through valve 37 will be relatively high causing the pressure drop across the valve to be relatively high, with most of the oil pressure drop from pressurized oil supply 39 to oil sump 41 being dropped across valve 37, rather than across fixed orifice 38. As the coolant temperature increases the duty cycle of coil 33 increases and the effective opening of valve 37 becomes larger, thereby introducing less restricton to the oil flow and less pressure drop. Consequently, as the coolant temperature rises the pressure drop decreases across valve 37 and increases across fixed orifice 38, causing the oil pressure in oil line 43 to increase toward the oil supply pressure as the coolant temperature increases. This oil pressure/coolant temperature function is shown in FIG. 2.

The controlled oil pressure in oil line 43 governs the operation of coolant flow control valve 45, radiator shutters 46 and variable speed fan drive 47, all three of which in turn control the temperature of the coolant in the radiator 48 of the internal combustion engine. At very low coolant temperatures, such as when the engine is started or in extremely cold weather, the controlled oil pressure will be so low that none of the devices 45, 46 and 47 will be operated, and thus will be established in their normal positions. Specifically, flow control valve 45, which controls the amount of coolant diverted from the engine jacket and circulated through radiator 48, will be in its fully closed position so that the coolant will be circulated by the coolant or water pump only around the engine jacket. The radiator shutters 46 will be fully closed so no ram air impinges the radiator, and the fan drive 47 will be off so no air will be blown through the radiator. As the engine temperature and the coolant temperature increase, the controlled oil pressure in line 43 increases and flow control valve 45 opens in proportion to the temperature rise, allowing the coolant trapped in the engine jacket to flow through the radiator to dissipate the heat absorbed from the engine by the coolant. During this time the radiator shutters 46 and fan drive 47 will be unaffected since they are constructed so they will not operate in response to the low oil pressure to which control valve 45 responds.

Figure 2:
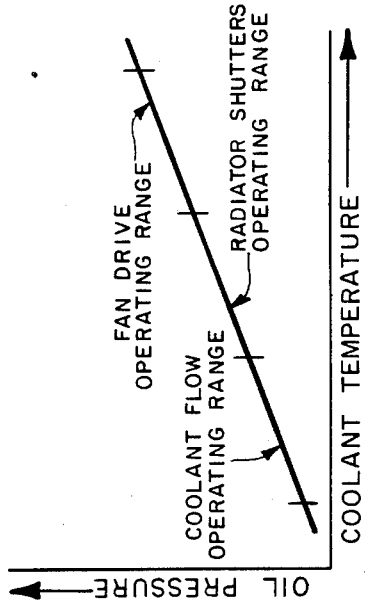
FIG. 2 shows a characteristic curve that will be helpful in understanding the operation of the temperature control system; and, FIG. 3 shows a portion of the temperature control system of FIG. 1 modified in accordance with another embodiment of the invention.

This operation at low temperatures is illustrated in FIG. 2. If the coolant temperature increases to the extent that the increased oil pressure fully opens flow control valve 45, all of the coolant will be circulated through the radiator to be cooled. This occurs at the high temperature end of the low temperature range indicated by the legend "coolant flow operating range" in FIG. 2. If at that time insufficient cooling occurs in the radiator, causing the engine temperature to continue rising, the radiator shutters begin to open. The pressure controlled actuator for the radiator shutters is adjusted so that no movement thereof occurs until the oil pressure exceeds the level at which flow control valve 45 becomes fully opened. As the shutters open, in response to increasing oil pressure, more and more ram air is allowed to strike the radiator to dissipate heat absorbed by the coolant. Depending on the vehicle's speed and ambient air temperature, the coolant may be cooled sufficiently to stabilize the engine temperature at the desired level required for optimum engine performance.

Assume now that external or load conditions prevent adequate cooling, even with the flow control valve 45 and the radiator shutters 46 fully open, and the coolant becomes hotter. This point is indicated by the high temperature end of the medium temperature range, or "radiator shutters operating range" in FIG. 2. At that point the oil pressure in line 43 will be sufficient to cause fan drive 47 to start rotating the fan to pull air through the radiator to effect additional cooling of the coolant. If the coolant temperature still keeps rising in the range indicated by the high temperature range or "fan drive operating range" in FIG. 2, the increasing oil pressure causes the fan drive 47 to gradually increase the fan speed until the cooling effect on the coolant is sufficient to stabilize its temperature, and consequently the engine temperature, within the desired narrow limits for optimum engine performance.

The described engine temperature control arrangement of FIG. 1 thus effects very close control of the engine operating temperature, maintaining it within a relatively narrow operating range even in the presence of widely varying external and load conditions to achieve higher efficiency and longer engine life. Morever, hysteresis is substantially reduced and a much faster response to temperature change is obtained.

Figure 3:
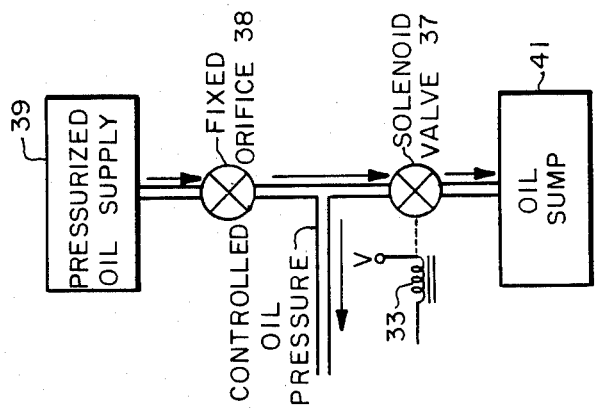

FIG. 3 shows the manner in which the temperature control system of FIG. 1 may be modified to provide a controlled oil pressure which is inversely proportional to the sensed temperature of the coolant. This is accomplished merely by reversing the order of solenoid valve 37 and fixed orifice 38 in the oil circuit. Hence, the oil pressure/coolant temperature characteristic curve will be a straight line as in FIG. 2 but will have an opposite polarity slope. At low coolant temperatures valve 37 introduces a high flow restriction and most of the pressure drop will be across that valve, the oil pressure at the junction of orifice 38 and valve 37 thereby being high. Conversely, at high coolant temperatures valve 37 presents a low flow restriction and most of the pressure drop will be across orifice 38. Of course, the pressure actuated devices 45, 46 and 47 must be of the type that operate in a reverse manner as previously explained in connection with FIG. 1. In other words, at low temperatures when the controlled oil pressure begins to drop from its maximum level as the coolant heats up, flow control valve 45 would begin to open. If the coolant temperature continues to increase into and through the medium temperature range, the oil pressure continues to drop and causes the radiator shutters to open. Assuming that the coolant temperature still keeps rising, the decreasing oil pressure occurring during the high temperature range causes the fan speed to gradually increase until the necessary amount of air is pulled through the radiator to properly cool the coolant. An advantage of the FIG. 3 embodiment is that since the lower the oil pressure the greater the cooling imparted to the coolant, if there is a failure in the oil supply or valve opening maximum cooling of the coolant will occur. The flow control valve 45 and the radiator shutters 46 will become fully opened and the fan will be driven by fan drive 47 at its maximum speed. This is a safety feature to prevent engine overheating in the event of a breakdown in the source of pressurized fluid or valve operation.

While particular embodiments of the invention have been shown and described, modifications may be made, and it is intended in the appended claims to cover all such modifications as may fall within the true spirit and scope of the invention.

What is claimed is:

1. An engine temperature control system for maintaining the temperature of coolant, in the engine jacket of an internal combustion engine, within desired narrow limits regardless of external conditions and load on the engine, comprising:

a radiator through which the coolant may be circulated from the engine jacket to effect cooling of the coolant;

a temperature sensor for sensing the temperature of the coolant in the engine jacket;

means responsive to said temperature sensor for producing a controlled fluid pressure which is a function of and represents the sensed temperature;

a coolant flow control valve which responds to the fluid pressure, when the sensed coolant temperature is in a relatively low temperature range, to vary the amount of coolant diverted to and flowing through the radiator;

radiator shutters controlled by the fluid pressure, when the sensed temperature is in a medium temperature range above the low temperature range, for adjusting the amount of ram air impinging on the radiator;

and a variable speed fan drive responsive to the fluid pressure, when the sensed coolant temperature is in a relatively high temperature range above the medium range, for blowing a controlled amount of air through the radiator.

2. An engine temperature control system according to claim 1 wherein the controlled fluid pressure is directly proportional to the sensed temperature of the coolant.

3. An engine temperature control system according to claim 1 wherein the controlled fluid pressure is inversely proportional to the sensed temperature of the coolant.

4. An engine temperature control system according to claim 1 and including a pulse width modulation circuit for producing, in response to said temperature sensor, a pulse width modulated signal having a duty cycle which is proportional to the sensed coolant temperature, the pulse width modulated signal being utilized to provide the controlled fluid pressure.

5. An engine temperature control system according to claim 4 and including means responsive to said temperature sensor for providing a temperature signal having an amplitude proportional to the sensed temperature, and wherein said pulse width modulated signal is developed in response to the temperature signal.

6. An engine temperature control system according to claim 5 wherein said temperature signal is applied to a comparator which also receives a triangular shaped signal, said pulse width modulated signal being produced at the output of said comparator.

7. An engine temperature control system according to claim 4 wherein the controlled fluid pressure is proportional to the duty cycle of said pulse width modulated signal and is produced by supplying pressurized fluid to a solenoid off-on valve operated by the pulse width modulated signal, the effective opening of the solenoid valve and the pressure drop thereacross being proportional to the duty cycle of the pulse width modulated signal.

8. An engine temperature control system according to claim 7 wherein the pressurized fluid is pressurized oil which flows through an oil circuit from a pressurized oil supply through said solenoid off-on valve and then through a fixed orifice and finally back to the oil supply, the controlled fluid pressure being directly proportional to the sensed temperature of the coolant and being developed at the junction in the oil circuit between the output of the solenoid valve and the input to the fixed orifice.

9. An engine temperature control system according to claim 7 wherein the pressurized fluid is pressurized oil which flows through an oil circuit from a pressurized oil supply through a fixed orifice and then through said solenoid off-on valve and finally back to the oil supply, the controlled fluid pressure being inversely proportional to the sensed temperature of the coolant and being developed at the junction in the oil circuit between the output of the fixed orifice and the input to the solenoid valve.

10. An engine temperature control system for maintaining the temperature of coolant, in the engine jacket of an internal combustion engine, within desired narrow limits despite wide variations of external conditions and load on the engine, where a flow control valve controls the coolant flow from the engine jacket to a radiator having controllable shutters for varying the amount of ram air striking the radiator, and where a variable speed fan drive controls the amount of air blown through the radiator, said engine temperature control system comprising:

a temperature sensor for sensing the temperature of the coolant in the engine jacket;

means responsive to said temperature sensor for producing a controlled fluid pressure which is a function of and represents the sensed temperature;

and means, responsive to the fluid pressure, for sequentially operating the flow control valve, radiator shutters and variable speed fan drive as the sensed coolant temperature rises through predetermined low, medium and high temperature ranges, the flow control valve increasing the amount of coolant circulating through the radiator as the sensed temperature increases in the low temperature range, the radiator shutters increasing the amount of ram air impinging on the radiator as the sensed temperature increases in the medium temperature range, and the fan drive increasing the amount of air pulled through the radiator as the temperature increases in the high temperature range.

11. An engine temperature control system for controlling the temperature of coolant in the engine jacket of an internal combustion engine, where the coolant may be circulated, via a flow control valve, around the engine jacket and through a radiator having controllable shutters for varying the amount of ram air that may impinge on the radiator, a variable speed fan drive being provided to control the amount of air blown through the radiator, said engine temperature control system comprising:

a temperature sensor for sensing the temperature of the coolant in the engine jacket;

means responsive to said temperature sensor for producing a pulse width modulated signal having a duty cycle which is proportional to the sensed temperature;

a source of pressurized fluid;

means, coupled to said source of pressurized fluid and responsive to said pulse width modulated signal, for producing a controlled fluid pressure which is proportional to the sensed temperature;

means for utilizing said controlled fluid pressure, when the sensed coolant temperature is in a relatively low temperature range, for controlling the position of the coolant flow control valve to vary the amount of coolant diverted to and flowing through the radiator, the flow control valve being fully open to circulate all of the coolant through the radiator when the sensed coolant temperature is at the high end of the low temperature range;

means for utilizing said controlled fluid pressure, when the sensed coolant temperature is in a medium temperature range above the low temperature range, for adjusting the position of the radiator shutters to vary the amount of ram air striking the radiator, the shutters being fully open to maximize the amount of ram air when the sensed coolant temperature is at the high end of the medium temperature range;

and means for utilizing said controlled fluid pressure, when the sensed coolant temperature is in a relatively high temperature range above the medium temperature range, for varying the speed of the fan drive to control the amount of air pulled through the radiator, thereby to maintain the coolant temperature within desired narrow temperature limits regardless of external conditions and load on the engine.

* * * * *